US012690638B2

(12) United States Patent
Van Horne et al.

(10) Patent No.: US 12,690,638 B2
(45) Date of Patent: Jul. 28, 2026

(54) ADDITIVE MANUFACTURED TONGUE FOR SKATE BOOT

(71) Applicant: VH Footwear ULC., Calgary (CA)

(72) Inventors: Scott Van Horne, Winnipeg (CA); Tyler Anthony Williamson Derraugh, Winnipeg (CA); Anthony Salahor, Winnipeg (CA)

(73) Assignee: VH Footwear ULC., Calgary (CA)

( * ) Notice: Subject to any disclaimer, the term of this patent is extended or adjusted under 35 U.S.C. 154(b) by 63 days.

(21) Appl. No.: 18/752,119

(22) Filed: Jun. 24, 2024

(65) Prior Publication Data

US 2025/0386895 A1 Dec. 25, 2025

(51) Int. Cl.
*A43B 5/16* (2006.01)
*A43B 23/26* (2006.01)

(52) U.S. Cl.
CPC ..... *A43B 5/16* (2013.01); *A43B 23/26* (2013.01)

(58) Field of Classification Search
CPC ..... A43B 23/26; A43B 5/16
See application file for complete search history.

(56) References Cited

U.S. PATENT DOCUMENTS

2012/0167418 A1* 7/2012 Frappier ..... A43B 23/26 36/115
2019/0261735 A1* 8/2019 Wawrousek ..... A43D 1/02
2023/0337781 A1* 10/2023 Corbeil ..... A63C 1/42
2024/0367380 A1* 11/2024 Mccutcheon ..... B22F 10/80

FOREIGN PATENT DOCUMENTS

EP 3257392 A1 * 12/2017 ..... A43B 23/0225

* cited by examiner

*Primary Examiner* — Ted Kavanaugh
(74) *Attorney, Agent, or Firm* — IPHORGAN LTD.

(57) ABSTRACT

A skate tongue for a skate boot is formed by additive manufacturing. The tongue has a body comprising a lattice structure having a plurality of different lattice configurations so as to collectively occupy a majority of an internal volume of the tongue body. Different regions within the tongue body may have lattice configurations that differ from one another by one or more of lattice pattern, cell size, density, and beam diameter such that the performance characteristics of the tongue body vary in one or more of toughness, strength, durability, density, porosity, flexibility, weight, impact resistance, and heat dissipation. The additive manufacturing process allows the skate tongue to be readily customized according to user selections related to desired performance characteristics and/or personalized three dimensional indicia.

20 Claims, 7 Drawing Sheets

ADDITIVE MANUFACTURED TONGUE FOR SKATE BOOT

FIELD OF THE INVENTION

The present invention relates to a tongue for a skate boot, and more particularly the present invention relates to a unique structure of the tongue of a skate boot that is formed by additive manufacturing.

BACKGROUND

In the sport of hockey, a typical skate boot has a boot body including rigid materials that provide structural support in addition to some impact protection from pucks and the like. The skate boot includes a tongue opening with laces to enable the insertion and removal of the foot of the user and to enable tightening of the skate boot about the foot of the user once the foot is inserted. A skate tongue spans the skate opening to prevent the laces for directly biting against the foot of the user and is necessarily flexible to conform to the foot of the user for comfort and so as not to interfere with tightening of the skate boot about the foot of the user. Any impact protection in the area of the skate tongue has therefore traditionally been limited to use of dense and layered flexible materials which can add considerable weight to the overall skate boot, while being limited in the degree of protection offered.

SUMMARY OF THE INVENTION

According to one aspect of the invention there is provided a skate tongue for a skate boot having a tongue opening, the skate tongue comprising:

- a tongue body arranged to be received within the skate boot to span a majority of the tongue opening;
- the tongue body comprising a lattice structure occupying a respective portion of an internal volume of the tongue body;
- wherein at least the lattice structure of the internal region of the tongue body is formed by additive manufacturing.

The additive manufacturing of a tongue body with an internal lattice structure enables a tongue body to be formed which has many improved functional benefits such as impact protection, flexibility, breathability, protection from lace bite, structural support to the foot, and/or comfort, while remaining as lightweight as possible, so as to improve the overall performance benefits of the skate boot. In addition, the additive manufacturing process allows the skate tongue to be readily customized to user preferences such as toughness, strength, durability, density, porosity, flexibility, weight, impact resistance, heat dissipation, and/or customizations including personalised 3-dimensional surface indicia or texture representing player name, number or graphics.

Preferably a supporting structure of the tongue body is entirely formed by additive manufacturing.

Preferably the lattice structure occupies a majority of the internal volume of the tongue body.

The lattice structure preferably comprises a plurality of different lattice configurations. The lattice configurations may differ from one another by one or more of lattice pattern, cell size, density, and beam diameter. The lattice configurations may also differ from one another by one or more of toughness, strength, durability, density, porosity, flexibility and heat dissipation.

When the tongue body includes an interior surface for lying against a foot of a user of the skate boot and an exterior surface for defining a respective portion of an exterior of the skate boot, preferably an exterior region of the lattice structure adjacent to the exterior surface has a greater density that an interior region of the lattice structure adjacent to the interior surface. The exterior region preferably spans a metatarsal and tarsal region of the tongue body.

When the tongue body is elongated between a bottom end arranged for attachment to the skate boot and a top end opposite the bottom end, the lattice structure may comprises: (i) an intermediate region at an intermediate location between the top end and the bottom end of the tongue body having a first density, and (ii) at least one distal region between the intermediate region and one of the bottom end or the top end of the tongue body having a second density which is less than the first density.

The lattice structure may be in open communication with opposing boundaries of the tongue body such that the tongue body is porous and allows air to be readily transmitted through the tongue body.

Preferably at least a portion of an external boundary of the tongue body comprises a continuous sheet defining a boundary skin that is formed by additive manufacturing together with the lattice structure.

Preferably the boundary skin spans only a portion of the external boundary of the tongue body.

The boundary skin may extend about a perimeter edge portion of the tongue body which extends about a full perimeter of the tongue body.

When the tongue body includes an exterior surface for defining a respective portion of an exterior of the skate boot, the boundary skin may extend over a central portion of the exterior surface between opposing top and bottom ends of the tongue body.

When the tongue body includes an interior surface for lying against a foot of a user of the skate boot, the boundary skin may extend over a central portion of the interior surface between opposing top and bottom ends of the tongue body.

One or more external boundary surfaces may include a surface texture formed thereon in which the surface texture is integrally formed together with the lattice structure by additive manufacturing.

The tongue body may be entirely formed of a single uniform material extending continuously throughout the tongue body.

More particularly, the tongue body may be formed of a hydrophobic material.

According to a second aspect of the present invention there is provided a method of forming the skate tongue including the steps of:

- defining the skate tongue as three-dimensional printing instructions for additive manufacturing equipment; and
- using the additive manufacturing equipment to produce the skate tongue according to the three-dimensional printing instructions.

The method may further include receiving user input relating to features of the skate tongue, followed by modifying the printing instructions according to the user input, and using the additive manufacturing equipment to produce the skate tongue according to the modified printing instructions.

In one example, the user input relates to mechanical properties of the skate tongue such as toughness, strength, durability, density, porosity, flexibility, weight, impact resistance, and/or heat dissipation, in which the three-dimensional printing instructions are modified in order to change lattice pattern, cell size, density, surface skin, and/or beam diameter. In another example, the user input relates to custom three-dimensional surface indicia of the skate tongue such as personalized player name, a number or graphics.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
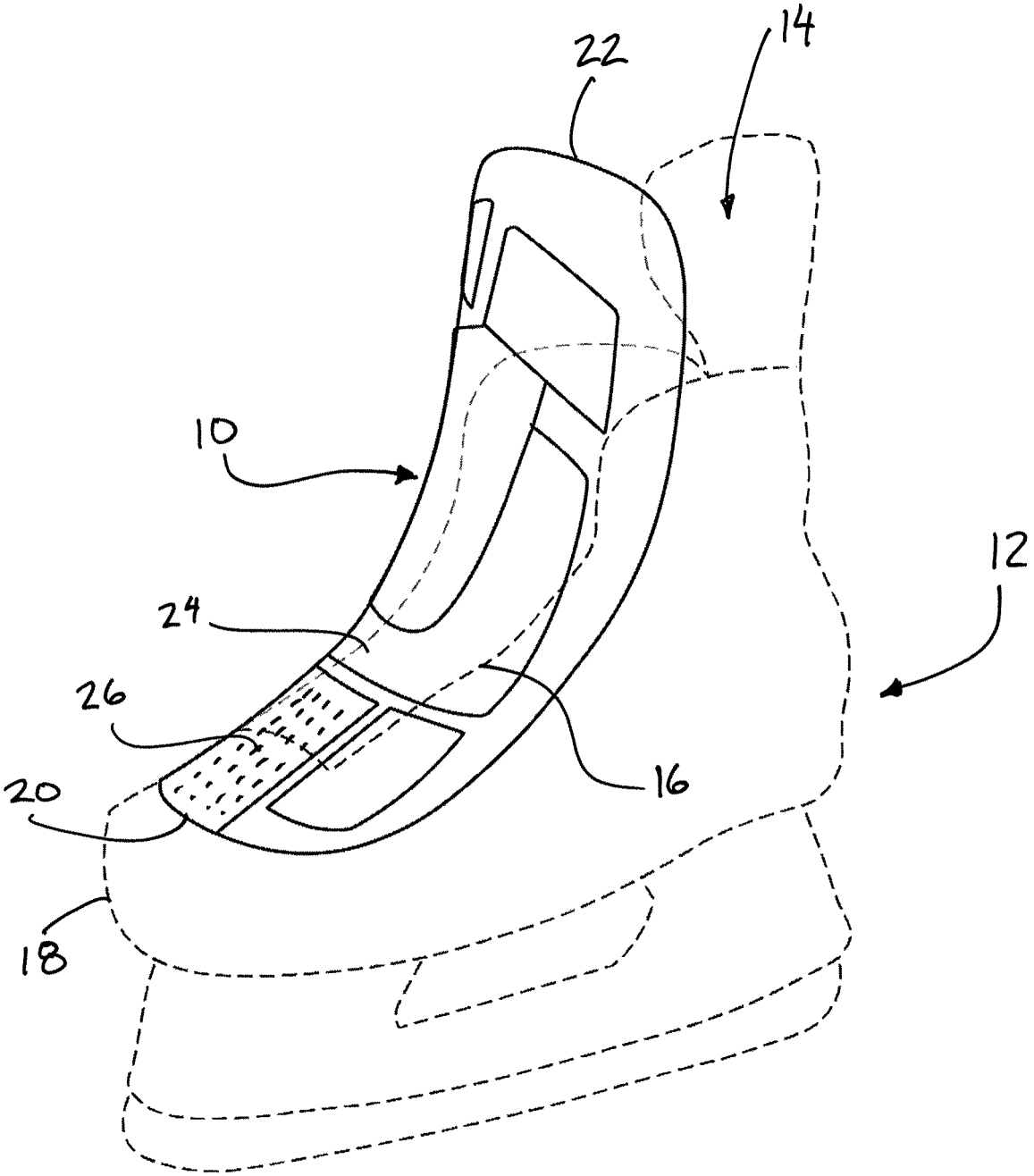
FIG. 1 is a perspective view of an exemplary skate boot upon which the skate tongue according to the present invention is supported.
Figure 3:
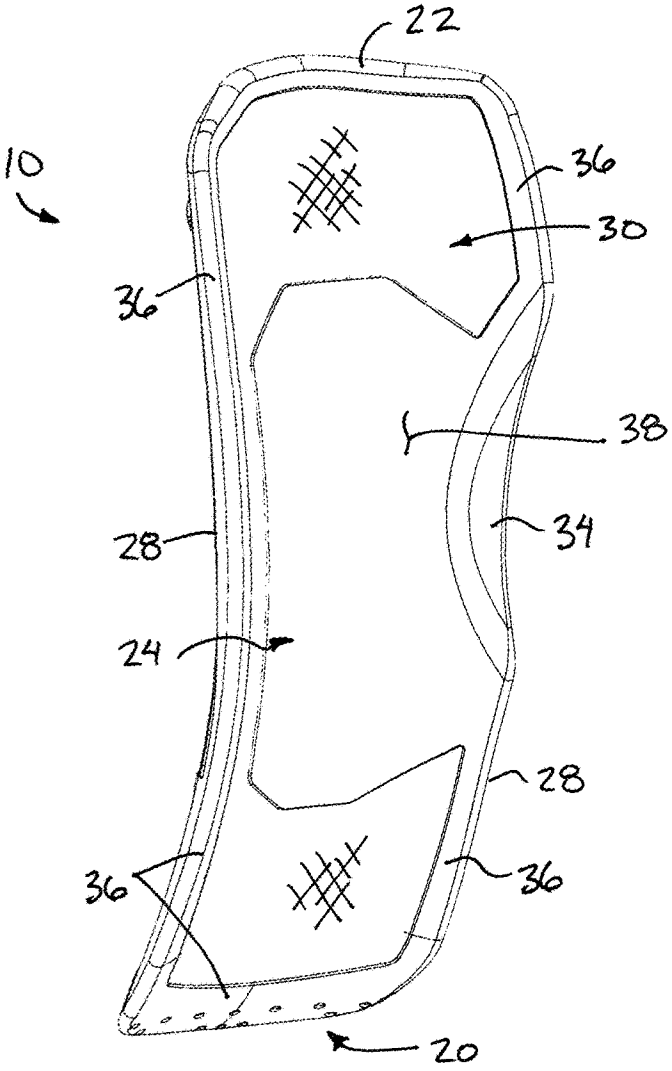
FIG. 3 is a perspective view of an interior or rear side of the skate tongue.
Figure 2:
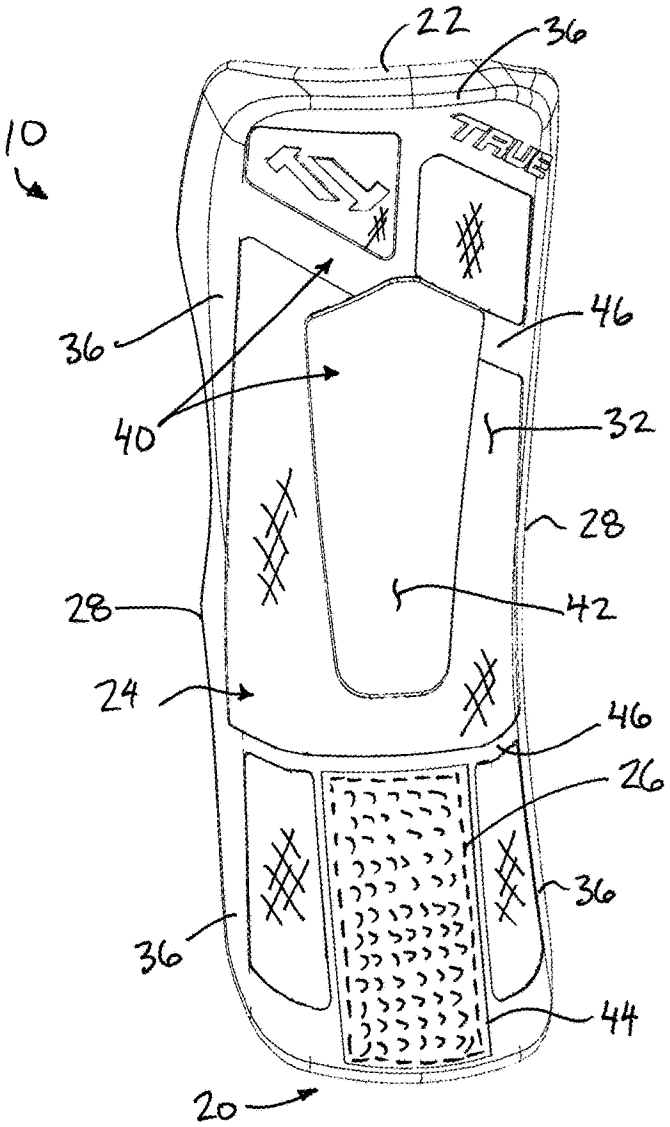
FIG. 2 is a perspective view of an exterior or front side of the skate tongue.
Figure 4:
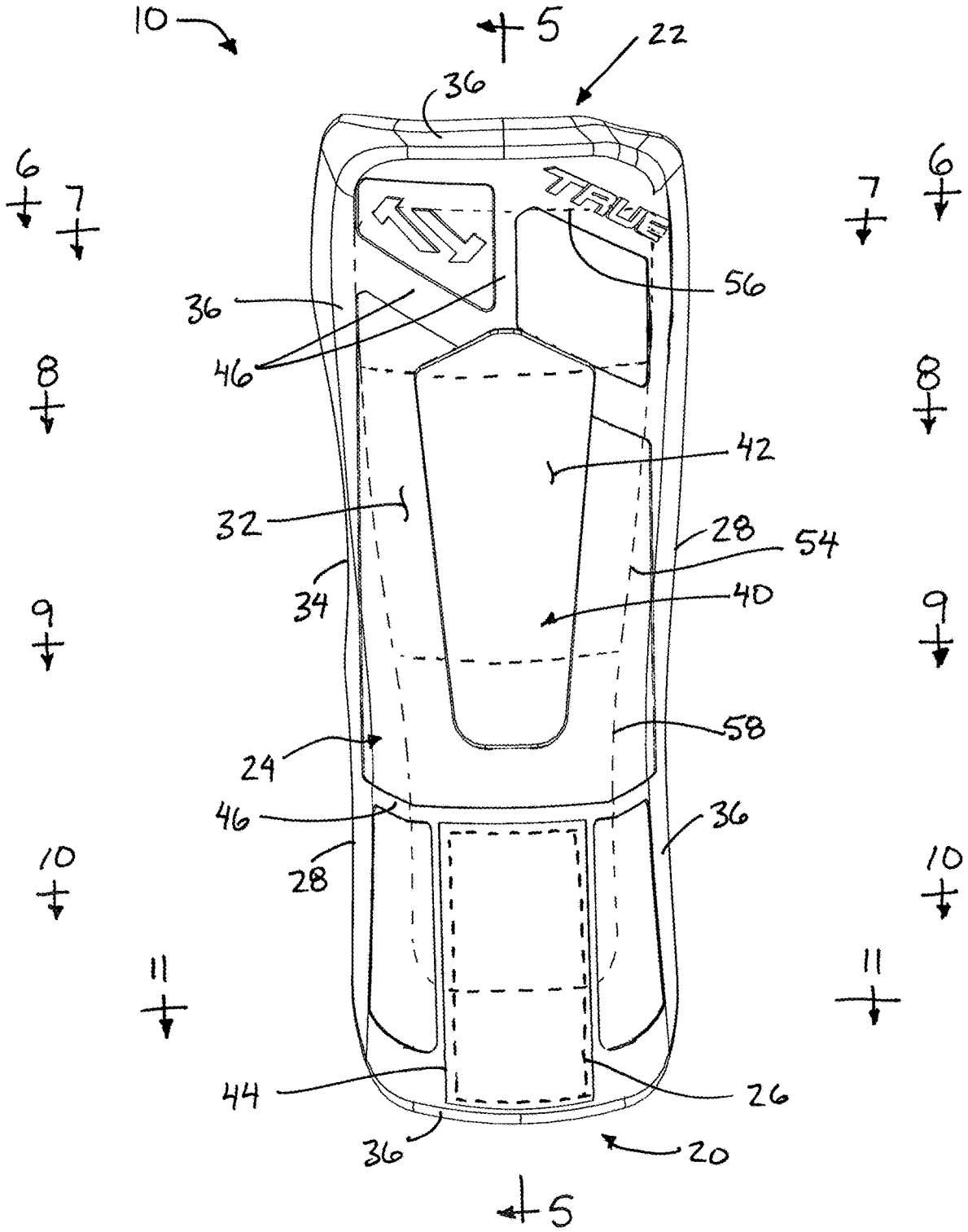
FIG. 4 is a front elevational view of the skate tongue in which an outline of the internal regions occupied by various lattice configurations are shown in broken line.

Referring to the accompanying figures there is illustrated a skate tongue generally indicated by reference numeral 10.

The skate tongue 10 is arranged for use with a skate boot 12 that receives the foot of a user therein when skating, for example ice skating or roller skating. The skate boot 12 has an upper opening 14 at the top to receive the foot of the user inserted therein, and an elongated tongue opening 16 extending along the top side of the boot from a top end that is open to the upper opening 14 of the skate boot to a forward or bottom end that terminates at the toe cap 18 of the skate boot.

The skate tongue 10 is elongated in a longitudinal direction between a forward/bottom end 20 and a rear/top end 22 of the skate tongue so that the skate tongue 10 spans a length of the tongue opening when mounted on the skate boot. The bottom end 20 of the skate tongue is mounted onto the front end of the tongue opening 16 at the toe cap 18 of the skate boot as described in further detail below. In use, laces (not shown) span externally across the skate tongue 10 for tightening the skate boot 12 about the foot of the user.

According to the illustrated embodiment, the skate tongue 10 consists solely of (i) a tongue body 24, and (ii) an attachment arrangement 26 that secures the tongue body 24 to the toe cap 18 of the skate boot. The tongue body 24 is entirely formed of as a single, unitary structure produced by additive manufacturing in a continuous manufacturing process so that the resulting tongue body is continuous and seamless, being formed of the same material throughout; however, internal regions of the tongue body area each comprise an internal lattice structure produced by the additive manufacturing process in which the lattice structure varies in configuration throughout the tongue body between the different internal regions.

More particularly, one or more internal regions, that collectively occupy some or the entirety of the internal volume of the tongue body, are constructed as a conformal lattice structure defined by a mathematical model or algorithm. The one or more internal regions are distinguished from one another by each having a respective specified lattice configuration in which the lattice structures of the different regions are adapted to conform with one another and with the overall geometry of the tongue body. The different regions within the tongue body have lattice configurations that differ from one another by one or more of lattice pattern, cell size, density, and beam diameter such that the performance characteristics of the tongue body vary in one or more of toughness, strength, durability, density, porosity, flexibility, weight, impact resistance, and heat dissipation between the different regions of the lattice structure.

The tongue body is generally constructed such that it is elongated in a longitudinal direction between the top end 22 and the bottom end 20 thereof while spanning in a lateral direction to define a width between two opposing side edges 28 that span longitudinally between the top and bottom ends of the body. The two opposing side edges 28, the top end 22, and the bottom end 20 collectively define a perimeter edge extending about a full perimeter of the tongue body between an interior boundary 30 at the interior side of the tongue body and an exterior boundary 32 at the exterior side of the tongue body. The interior side corresponds to the side surface of the tongue body that engages against the foot of the user within the interior of the skate boot in use, whereas the exterior side corresponds to the surface of the tongue body facing outwardly and defining a portion of the exterior of the finished skate boot in use.

The tongue body is shaped so that the interior and exterior boundaries form compound curved surfaces. More particularly, the interior surface 30 is concave in the lateral direction between the side edges 28 and convex in the longitudinal direction between the top end 22 and the bottom end 20. The exterior surface 32 of the tongue body generally follows the profile of the interior surface so that the exterior surface is convex in the lateral direction between the side edges 28 and concave in the longitudinal direction between the top and 22 and the bottom and 20.

The thickness of the tongue body between the interior and exterior surfaces is greatest at a central location in the lateral and longitudinal directions. The thickness is tapered and reduced towards the opposing side edges 28 in the lateral direction while being tapered and reduced towards the opposing top end 22 and bottom end 20 in the longitudinal direction.

The tongue body is asymmetrical about a vertical plane perpendicular to the lateral direction at a lateral central location. In this regard, the medial side edge 28 includes an additional medial recess 34 which is recessed laterally inwardly at an intermediate location along the height of the tongue body.

In the illustrated embodiment, the internal regions defined by internal lattice structures occupy substantially the entirety of the interior volume of the tongue body with the exception of a boundary skin provided along a portion of the external boundary of the tongue body. At locations devoid of a boundary skin, the internal lattice structure defining the internal regions extends to and is exposed at the external boundary of the tongue body such that the open lattice structure is open and porous to the exterior of the tongue body.

At regions of the external boundary occupied by a boundary skin, the boundary skin comprises a continuous, solid material extending as a non-porous sheet over a respective portion of the external boundary of the tongue body. The boundary skin according to the illustrated embodiment includes (i) a perimeter skin 36 at the perimeter edge between the interior and exterior surfaces of the tongue body, (ii) an interior skin 38 covering part of the interior surface 30 at the interior boundary of the tongue body, and (iii) an exterior skin 40 covering part of the exterior surface 32 at the exterior boundary of the tongue body.

The perimeter skin 36 extends about the full perimeter edge of the tongue body and overlaps an adjacent portion of both the interior and exterior surfaces of the tongue body adjacent to the perimeter edge about the full perimeter or circumference of the tongue body.

The interior skin 38 is provided as a central patch spanning over a central portion of the tongue body in the longitudinal direction between the top and bottom ends while occupying nearly the full width in the lateral direction. In the illustrated embodiment, the interior skin 38 occupying the central portion of the interior surface spans a majority of the length of the tongue body and in turn covers a majority of the surface area at the interior boundary of the tongue body. Preferably between 30% and 70% of the interior surface area is occupied by a boundary skin which is nonporous while the remaining 30% to 70% of the interior surface area remains open to the internal lattice structure so as to be porous and allow ventilation therethrough.

The exterior skin 40 is also provided as a central patch 42 spanning over a central portion of the tongue body in the longitudinal direction between the top and bottom ends while occupying nearly half of the overall length in the longitudinal direction. The exterior central patch 42 occupies less than half of the overall width in the lateral direction while being generally centred in the lateral direction so that a portion of the internal lattice structure remains exposed along both laterally opposing sides of the central patch 42 between the exterior skin and the surrounding perimeter skin 36.

The exterior skin 40 also includes a lower patch 44 provided as an elongated strip that is laterally centred and extends upward from the bottom end of the tongue body so that a portion of the internal lattice structure remains exposed along laterally opposing sides of the lower patch 44. The lower patch 44 terminates at a top end space below the bottom boundary of the central patch 42 to also provide a strip of exposed internal lattice structure above the lower patch 44 and below the central patch 42 where the external boundary remains porous.

The exterior skin 40 also includes a plurality of connecting strips 46 provided as a grid pattern interconnected between parts of the lower patch 44, the central patch 42, and the surrounding perimeter skin 36.

Overall, between 30% and 70% of the exterior surface area is occupied by the exterior skin 40 which is nonporous, while the remaining 30% to 70% of the exterior surface area remains open to the internal lattice structure so as to be porous and allow ventilation therethrough. In this manner, a portion of the lattice remains open and exposed at opposing interior and exterior boundaries of the tongue body to allow air to be readily ventilated through the tongue body between the interior surface against the foot of the user and the exterior surface at the exterior of the skate boot for dissipating heat and moisture from the foot of the user to the exterior of the boot in use.

The lower patch 44 provides an external surface area onto which the attachment arrangement 26 can be secured which in turn secures the tongue body 24 to the toe cap 18 of the skate boot. In a preferred embodiment, the attachment arrangement 26 comprises a patch of hook or loop fasteners that is adhesively secured to the lower patch 44 of the exterior skin for selective attachment to a corresponding patch of loop or hook fasteners that can selectively mate with the patch of fasteners secured to the tongue body. In this manner, the tongue body is releasably and adjustably attached to the skate boot to span the tongue opening in use.

In the illustrated embodiment, the internal regions occupied by lattice structure include (i) an exterior region 50 spanning a majority of a height and a majority of a width of the internal volume of the tongue body in a first layer nearest to the exterior surface 32 of the tongue body, and (ii) an interior region 52 spanning a majority of a height and a majority of a width of the internal volume of the tongue body in a second layer between the exterior region 50 and the interior surface 30.

More particularly, the exterior region 50 occupies a central portion of the tongue body in the longitudinal direction and in the lateral direction so as to terminate at a location spaced longitudinally inwardly from both ends 20 and 22 and laterally inwardly from both side edges 28 of the tongue body. The exterior region 50 further comprises three subregions with differing lattice characteristics as described in further detail below.

Figure 5:
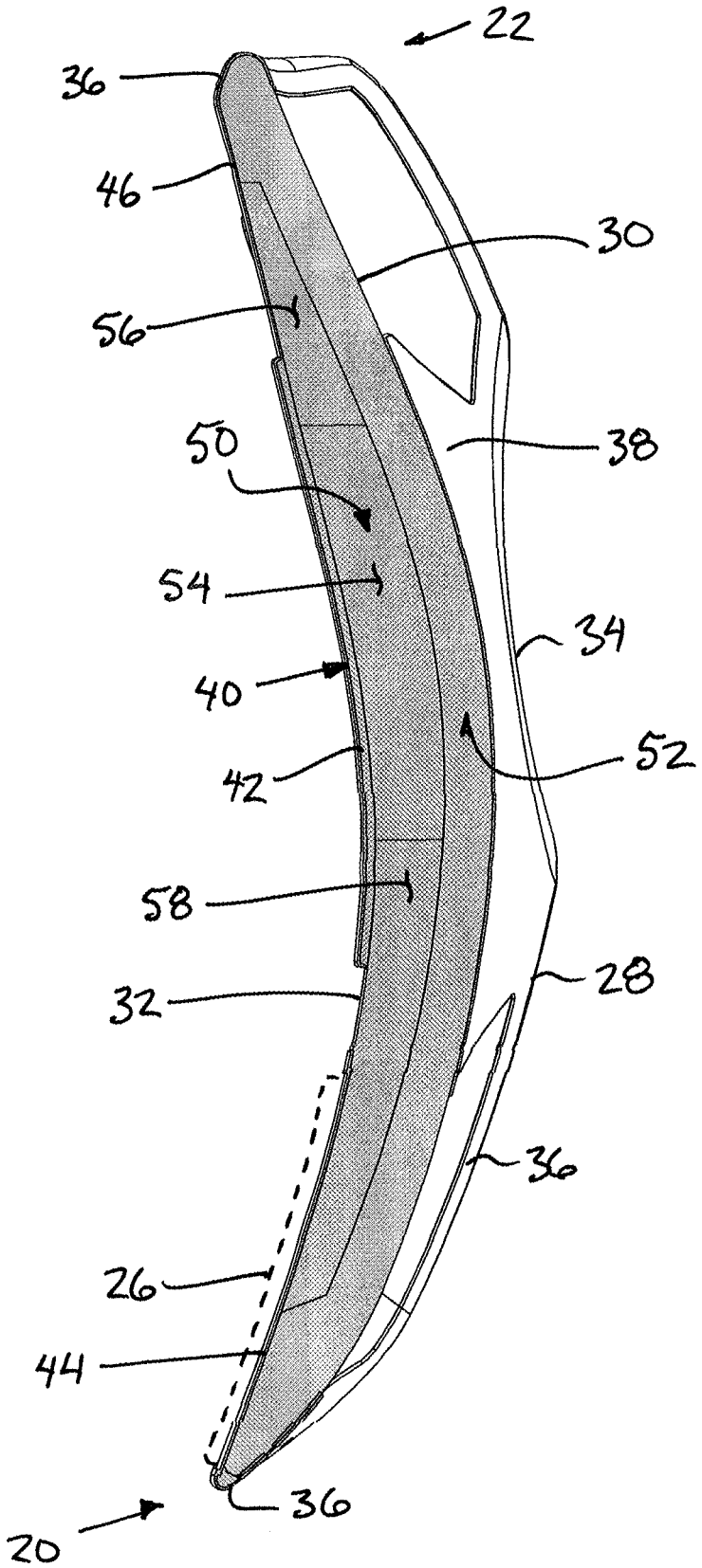
FIG. 5 is a sectional view along the line 5-5 in FIG. 4.
Figure 6:
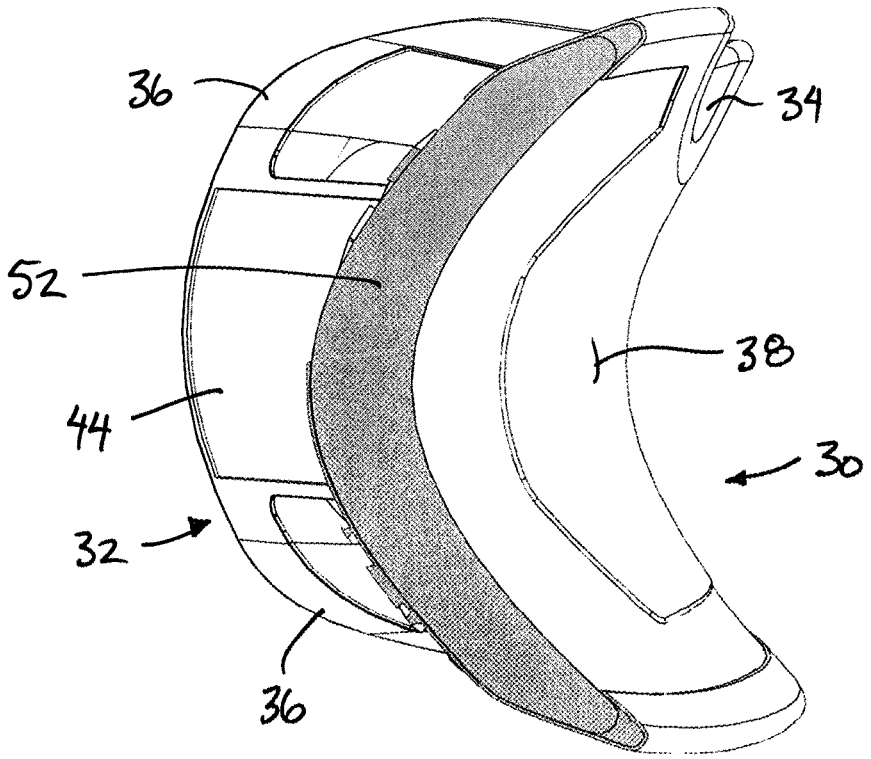
FIG. 6 is a sectional view along the line 6-6 in FIG. 4.
Figure 7:
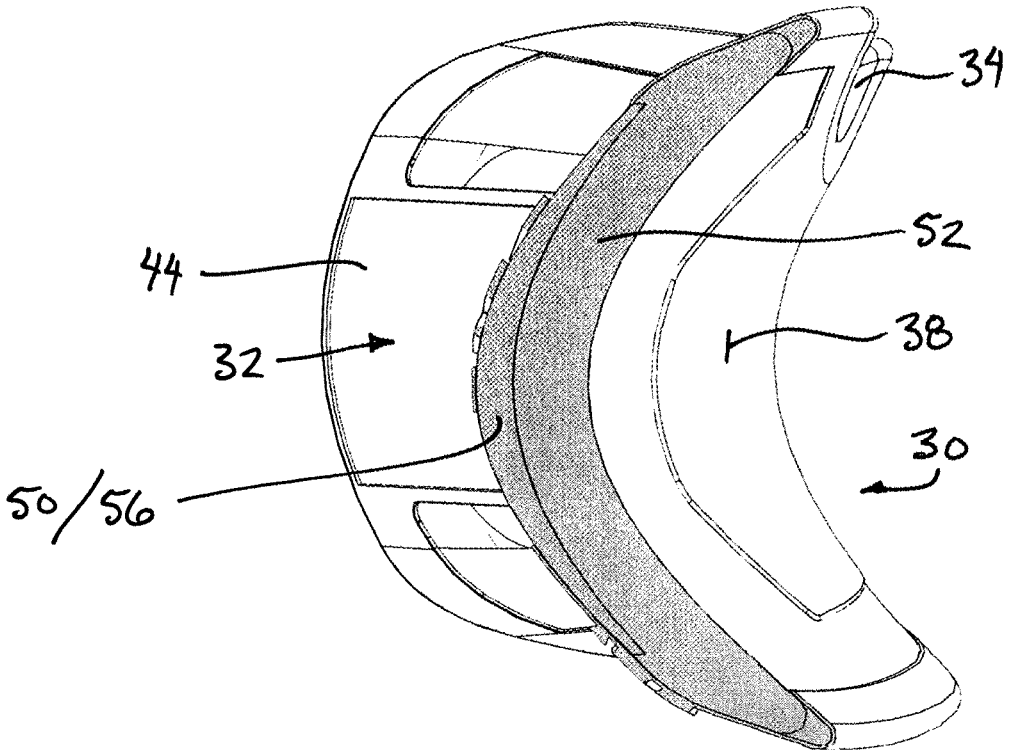
FIG. 7 is a sectional view along the line 7-7 in FIG. 4.
Figure 8:
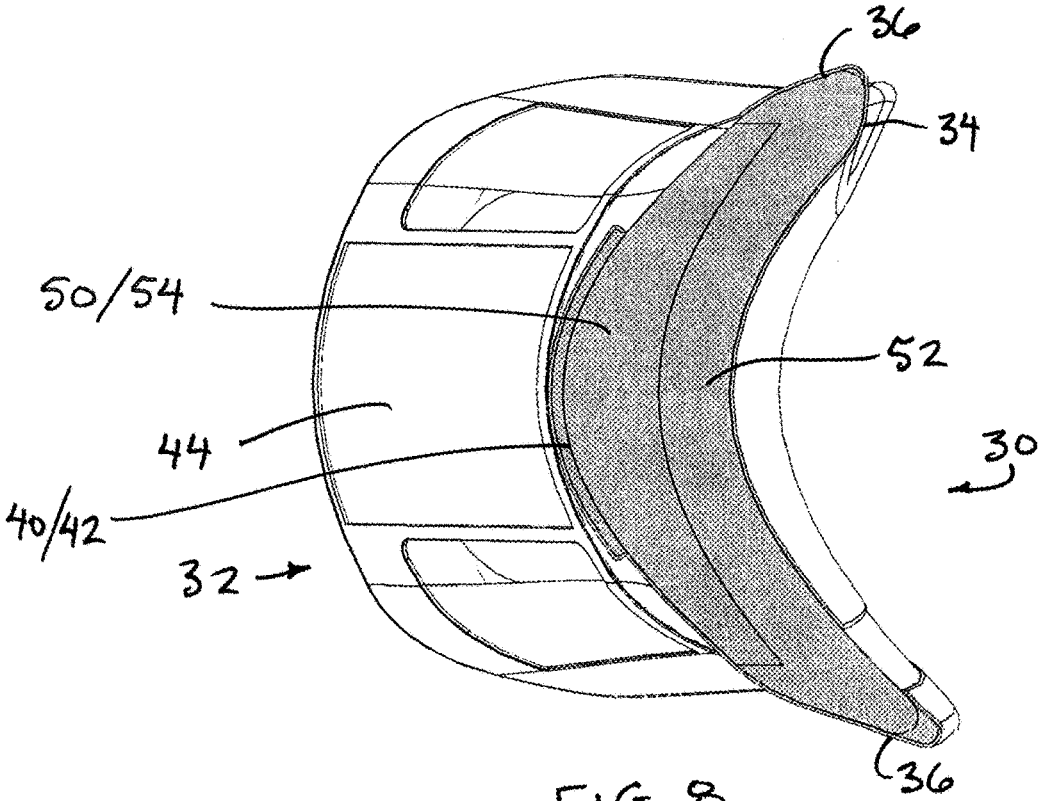
FIG. 8 is a sectional view along the line 8-8 in FIG. 4.
Figure 9:
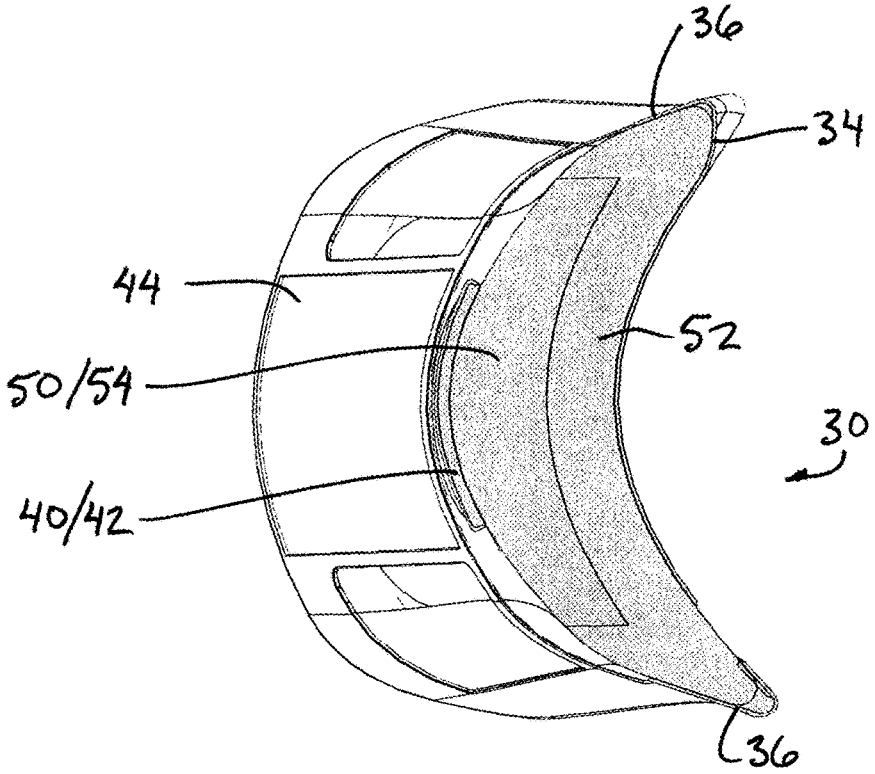
FIG. 9 is a sectional view along the line 9-9 in FIG. 4.
Figure 10:
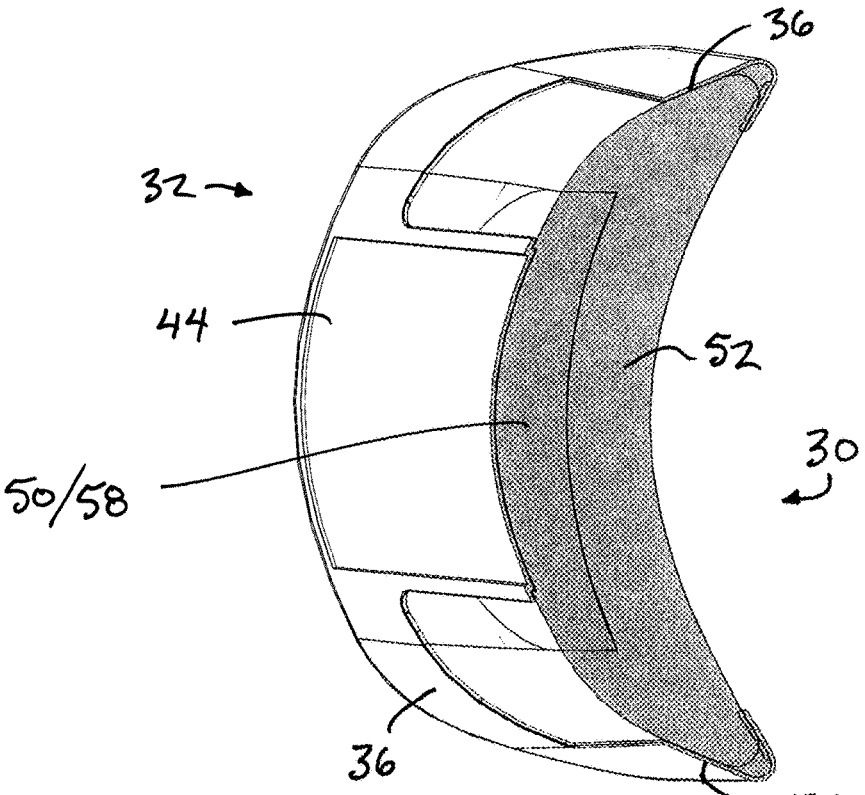
FIG. 10 is a sectional view along the line 10-10 in FIG. 4.
Figure 11:
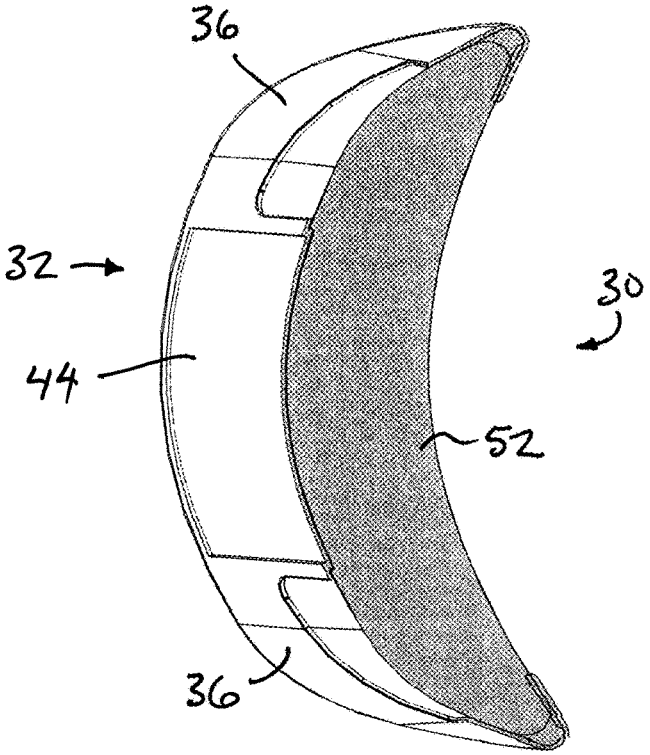
FIG. 11 is a sectional view along the line 11-11 in FIG. 4.

At the interior side of the tongue body, the interior region 52 spans the entire height and entire width along the interior of the tongue body such that the exterior region overlaps an exterior side of at least a portion of the interior region as shown in FIGS. 5, 8, 9 and 10. The interior region 52 of the internal lattice also spans a full thickness between the interior and exterior sides along the perimeter edge portion of the tongue body to surround the exterior region 50 at the laterally opposing side edges and the opposing top and bottom edges thereof. The interior region 52 at the interior surface and about the perimeter edge portion comprises a first lattice configuration throughout in which the lattice has a respective first lattice pattern, size and beam diameter with first properties of strength, flexibility and resilience associated therewith. The lattice configuration can be uniform or varied throughout the interior volume of the interior region 52 with at least some variation being provided at the boundary edges to conform to the boundary shape of the tongue body and to adjacent internal regions.

The subregions of the exterior region 50 of the tongue body are supported one above the other in a vertical row oriented in the longitudinal direction between the top and bottom ends of the tongue body. The exterior regions include a central region 54 overlapping a longitudinal center of the tongue body while spanning a full width of the exterior region 50. The central region 54 has a respective second lattice configuration throughout in which the lattice has a respective second lattice pattern, size and beam diameter with second properties of strength, flexibility and resilience associated therewith.

The subregions of the exterior region 50 also include an upper distal region 56 above the central region 54 and a lower distal region 58 below the central region 54. Each of the distal regions 56 and 58 spans a full width of the external region 50 so as to be narrower than the overall width of the tongue body. The upper and lower distal regions include respective third and fourth lattice configurations that span throughout the respective region. As above, the third lattice configuration has a respective third lattice pattern, size and beam diameter with third properties of strength, flexibility and resilience associated therewith, while the fourth lattice configuration has a respective fourth lattice pattern, size and beam diameter with fourth properties of strength, flexibility and resilience associated therewith.

Each of these first, second, third and fourth lattice configurations can also be uniform or varied throughout the interior volume of the respective region with at least some variation being provided at the boundary edges to conform to the boundary shape of the tongue body and to adjacent internal regions.

In the preferred arrangement, the second lattice configuration of the central region 54 of the exterior region 50 at the exterior side of the tongue body has the greatest density with the greatest beam diameter and the smallest cell size so as to be the strongest region with the most impact protection and the least flexibility. The central region 54 of the internal lattice is also substantially aligned with the central patch 42 of the exterior skin to reinforce the exterior skin against impacts and biting of the laces.

In contrast to the second lattice configuration of the central region 54, the first lattice configuration at the interior region 52, that includes the perimeter edge portion of the skate body, is the least dense internal region of the tongue body corresponding to the minimum beam diameter and the largest cell size so as to be the most flexible and most conformable part of the tongue body that conforms to the shape of the foot of the user and the adjacent structures of the skate boot that overlap the perimeter side edges of the tongue body in use.

The third and fourth lattice configurations of the upper distal region 56 and the lower distal region 58 may be configured similarly to one another or differ from one another, but in each instance the lattice structures of both distal regions 56 and 58 are denser than the first lattice configuration of the interior region 52 but less dense than the second lattice configuration of the central exterior region 54 of the internal volume. Accordingly, the beam diameters and cell sizes are intermediate in size between those of the first and second lattice configurations.

As described above, the entirety of the tongue body can be produced of a continuous material throughout that is formed in a single manufacturing operation by additive manufacturing. The common material defining the entirety of the tongue body is preferably formed of a resilient plastic material that entirely defines the structure and shape of the tongue body while allowing the tongue body to be resiliently deformable.

In some embodiments the common material is a hydrophobic material that repels moisture to assist in dissipation of moisture from the porous internal regions of the tongue body.

The structure of the tongue body, including the lattice configurations of the internal regions, and the boundary skin on the external regions can be collectively defined by suitable programming instructions for additive manufacturing equipment used to manufacture the tongue body. The programming instructions define a three-dimensional shape and structure of the tongue body and may include additional external surface details such as small-scale surface texture on external surfaces that conceal the transition lines that may otherwise be apparent between subsequent deposits of material from the additive manufacturing process. The surface texture may also bridge the junction between different lattice configurations to conceal the transition between the different lattice configurations underlying different portions of the external boundary skin.

The additional external surface details may also define large-scale surface texture defining three-dimensional indicia protruding from or recessed into the external boundary surfaces in which the indicia represent names, numbers or logos and the like that can be personalized to a particular user.

In order to produce a custom skate tongue for a particular user, a computer user interface associated with the additive manufacturing equipment, having a memory storing programing instructions and a processor to execute the instructions, can be configured to prompt the user with various selections and receive selections from the user through a computer input of the user interface. The selections can include personalized information to be represented as three-dimensional surface indicia, colour configurations, or performance characteristics such as desired strength, flexibility or impact resistance characteristics within one or more differing internal regions within the tongue body. In response to the user input, the computer controller will alter the programming instructions that define the three-dimensional shape of the tongue body prior to manufacturing. The method of manufacturing the tongue body then further includes using the instructions modified by the user selections as an input to the additive manufacturing equipment for manufacturing the tongue body according to the modified instructions. The entirety of the tongue body including the customizations are formed in a single step by additive manufacturing using the additive manufacturing equipment. Once complete, the attachment arrangement 26 (e.g. hook and loop fasteners) is secured to the lower patch 44 of external boundary skin of the tongue body 24 which enables subsequent mounting of the tongue body to the skate boot as described above.

The internal lattice configurations can take many forms which typically comprise a series of struts connected at nodes in a three-dimensional repeating pattern. The lattice structure may be configured in any one of numerous patterns or types including:

(i) polygon based lattices (e.g. hexagonal, rectangular, triangular, and circular);

(ii) strut based lattices (e.g. cubic, body-centered cubic, octet truss, all face-centered cubic, truncated cube, iso truss, BCC with Z strut, tetrahedron based, face-centered cubic, cuboctahedron, rhombic dodecahedron, kelvin cell, octahedron, diamond, and truncated cuboctahedron);

(iii) skeleton based lattices (e.g. gyroid, diamond, Schwarz, Neovius, splitP, and I-WP); or (iv) sheet TPMS (triply periodic minimal surface) based lattices (e.g. gyroid, diamond, Schwarz, Neovius, splitP, and I-WP).

As described herein, the skate body 24 is constructed of a single material that is constructed through an additive manufacturing process that is comprised of one or more pieces that are additively manufactured. The internal regions preferably comprise a conformal lattice that is defined by a mathematical model or algorithm and allows a specified lattice or plurality of lattices to adapt to the geometry of the tongue body. Within each internal region of the tongue body, a continuous lattice occupies the internal volume thereof that is comprised of one or more specifically defined the lattice cell types. The lattice type/pattern, lattice size, and lattice beam diameter can be varied to provide different mechanical properties at specific regions throughout the tongue. Preferably the outer surface has a higher density than the internal surface, achieved through varying lattice cell size, modifying beam diameter and changing lattice type. The continuous lattice has variable beam diameters and cell sizes to tune mechanical properties such as toughness, strength, durability, density, porosity, flexibility and heat dissipation.

The porous nature of the lattice structure that is open to external boundaries of the tongue body allow for heat dissipation and air cooling. The skinned areas at the external boundaries of the skate tongue are located in specific regions for improved durability and comfort, including along the tongue body's perimeter circumference, along part of the internal surface to improve comfort with the user's foot, and along part of the exterior surface.

At the exterior surface, the boundary skin is preferably thicker than other skinned areas to define an integrated guard by the combination of the thicker skin and the zonal latticing of the central exterior region 54 of the internal lattice structure. These are aligned with the top of the foot, and specifically the metatarsal and tarsal regions of the foot for protection against impacts and/or aggravation due to skate lace tension, commonly referred to as lace bite.

The printed-in surface texture acts to hide layer lines from the additive manufacturing process and reduces surface friction.

The configuration of the skate tongue which is customizable by additive manufacturing allows the lattice characteristics including type, cell size and beam diameter, to be modified to tune the mechanical and performance characteristics of the skate tongue including increased protection, reducing weight, breathability and tuning flexibility. The skate tongue can also incorporate custom engraving/texture moulded into the skin surfaces and open lattice sections such as personalized logos, phrases and branding. The skate tongue can be additively manufactured in any colour matching the PMS (Pantone matching system).

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A skate tongue for a skate boot having a tongue opening, the skate tongue comprising:

a tongue body arranged to be received within the skate boot to span a majority of the tongue opening;

the tongue body comprising a lattice structure occupying a respective portion of an internal volume of the tongue body;

wherein at least the lattice structure of the tongue body is formed by additive manufacturing; and wherein at least a portion of an external boundary of the tongue body comprises a continuous sheet defining a boundary skin that is formed by additive manufacturing together with the lattice structure.

2. The skate tongue according to claim 1 wherein a supporting structure of the tongue body is entirely formed by additive manufacturing.

3. The skate tongue according to claim 1 wherein the lattice structure occupies a majority of the internal volume of the tongue body.

4. The skate tongue according to claim 1 wherein the lattice structure comprises a plurality of different lattice configurations each occupying a respective internal region of the internal volume of the tongue body.

5. A skate tongue for a skate boot having a tongue opening, the skate tongue comprising:

a tongue body arranged to be received within the skate boot to span a majority of the tongue opening;

the tongue body comprising a lattice structure occupying a respective portion of an internal volume of the tongue body;

wherein at least the lattice structure of the tongue body is formed by additive manufacturing;

wherein the tongue body includes an interior surface for lying against a foot of a user of the skate boot and an exterior surface for defining a respective portion of an exterior of the skate boot;

wherein an exterior region of the lattice structure adjacent to the exterior surface has a greater density than an interior region of the lattice structure adjacent to the interior surface; and wherein the exterior region overlaps an exterior side of at least a portion of the interior region.

6. The skate tongue according to claim 5 wherein the exterior region spans a metatarsal and tarsal region of the tongue body.

7. The skate tongue according to claim 5 wherein the interior region of the lattice structure spans a full height and a full width of the exterior region of the lattice structure.

8. The skate tongue according to claim 5 wherein the exterior region of the lattice structure that overlaps the exterior side of at least a portion of the interior region of the lattice structure further comprises a central region overlapping a longitudinal center of the tongue body, an upper distal region above the central region and a lower distal region below the central region, wherein the upper distal region and the lower distal region of the lattice structure are both less dense than the central region of the lattice structure and wherein the upper distal region and the lower distal region of the lattice structure are both more dense than the interior region of the lattice structure.

9. The skate tongue according to claim 8 wherein the interior region of the lattice structure fully spans the central region, the upper distal region and the lower distal region of the lattice structure.

10. The skate tongue according to claim 1 wherein the tongue body is elongated between a bottom end arranged for attachment to the skate boot and a top end opposite the bottom end, and wherein the lattice structure comprises:

an intermediate region at an intermediate location between the top end and the bottom end of the tongue body having a first density; and at least one distal region between the intermediate region and one of the bottom end or the top end of the tongue body having a second density which is less than the first density.

11. The skate tongue according to claim 1 wherein the lattice structure is in open communication with opposing boundaries of the tongue body such that the tongue body is porous and allows air to be readily transmitted through the tongue body.

12. The skate tongue according to claim 1 wherein said boundary skin spans only a portion of the external boundary of the tongue body.

13. The skate tongue according to claim 1 wherein said boundary skin extends about a perimeter edge portion of the tongue body which extends about a full perimeter of the tongue body.

14. The skate tongue according to claim 1 wherein the tongue body includes an exterior surface for defining a respective portion of an exterior of the skate boot, and wherein said boundary skin extends over a central portion of the exterior surface between opposing top and bottom ends of the tongue body.

15. The skate tongue according to claim 1 wherein the tongue body includes an interior surface for lying against a foot of a user of the skate boot, and wherein said boundary skin extends over a central portion of the interior surface between opposing top and bottom ends of the tongue body.

16. The skate tongue according to claim 1 wherein at least one external boundary surface includes a surface texture formed thereon, the surface texture being formed together with the lattice structure by additive manufacturing.

17. The skate tongue according to claim 1 wherein the tongue body is entirely formed of a single uniform material extending continuously throughout the tongue body.

18. The skate tongue according to claim 1 wherein the tongue body is formed of a hydrophobic material.

19. A method of forming the skate tongue according to claim 1, the method comprising:

defining the skate tongue as three-dimensional printing instructions for additive manufacturing equipment; and using the additive manufacturing equipment to produce the skate tongue according to the three-dimensional printing instructions.

20. The method according to claim 19 further comprising:

receiving user input relating to (i) mechanical properties of the skate tongue and/or (ii) custom three-dimensional surface indicia of the skate tongue;

modifying the printing instructions according to the user input; and using the additive manufacturing equipment to produce the skate tongue according to the modified printing instructions.

* * * * *